US008894426B2

(12) United States Patent
Gette

(10) Patent No.: US 8,894,426 B2
(45) Date of Patent: Nov. 25, 2014

(54) SOCKET FOR AN ELECTRICAL PLUG-AND-SOCKET CONNECTION

(71) Applicant: Erich Jaeger GmbH & Co. KG, Friedberg (DE)

(72) Inventor: Johannes Gette, Wöffersheim (DE)

(73) Assignee: Erich Jaeger GmbH & Co. KG, Friedberg (DE)

( * ) Notice: Subject to any disclaimer, the term of this patent is extended or adjusted under 35 U.S.C. 154(b) by 120 days.

(21) Appl. No.: 13/851,281

(22) Filed: Mar. 27, 2013

(65) Prior Publication Data

US 2014/0295684 A1 Oct. 2, 2014

(51) Int. Cl.
*H01R 13/44* (2006.01)
*H01R 13/627* (2006.01)
*H01R 13/453* (2006.01)

(52) U.S. Cl.
CPC ..... *H01R 13/6275* (2013.01); *H01R 13/453* (2013.01)
USPC ..... 439/137

(58) Field of Classification Search
CPC ..... H01R 13/453; H01R 13/6275
USPC ..... 439/137, 135, 138
See application file for complete search history.

(56) References Cited

U.S. PATENT DOCUMENTS 7,554,034 B2 * 6/2009 Smith ..... 174/53
7,828,708 B2 11/2010 Huang et al.

FOREIGN PATENT DOCUMENTS

EP 2535985 A1 12/2012
WO 2012019625 A1 2/2012

* cited by examiner

*Primary Examiner* — Javaid Nasri
(74) *Attorney, Agent, or Firm* — McDonnell Boehnen Hulbert & Berghoff LLP

(57) ABSTRACT

Socket for an electrical plug-and-socket connection comprising a socket housing having a plug-in opening for mating with a plug, a cover for closing the plug-in opening and contacts. A contact insert with receptacle contacts connected with the contacts by inserting the insert on connection ends of the contacts, the receptacle contacts being connectable with a wire each. A backshell being held in the housing and having a flexible latch for fixing in a recess of the socket housing as a snap fit. A locking slider captively attached at the backshell and comprising two arms insertable into respective slits in said housing and the backshell, the slits matching each other when the contact insert in the backshell is inserted on the connection ends of the contacts such that the arms of the locking slider inserted into the matching slits secure the backshell with the contact insert.

18 Claims, 6 Drawing Sheets

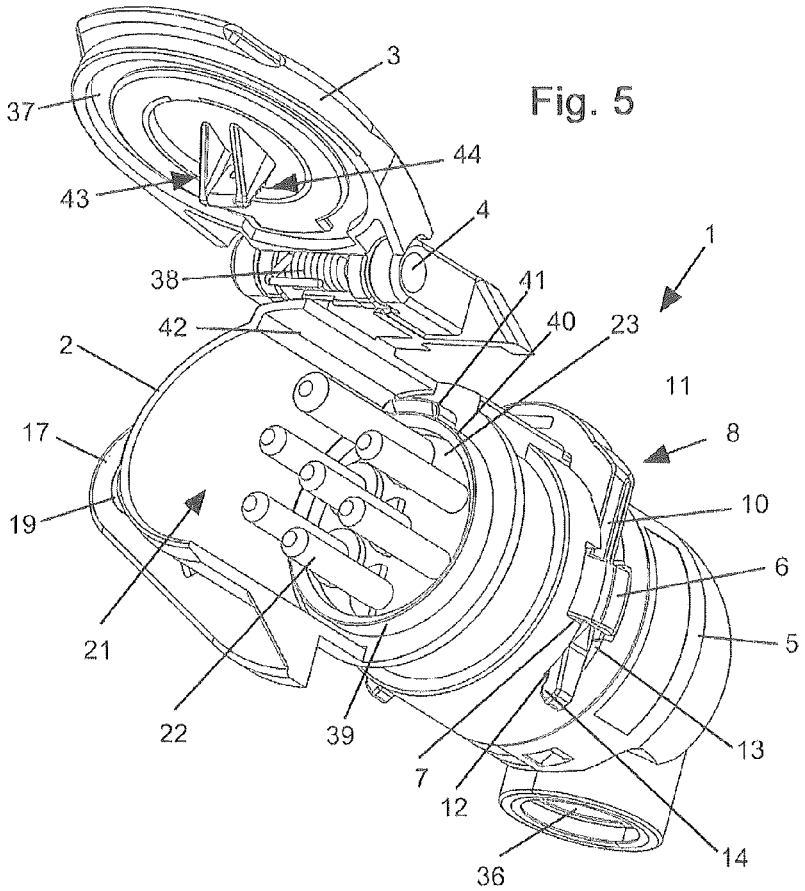
Fig. 5
Fig. 6
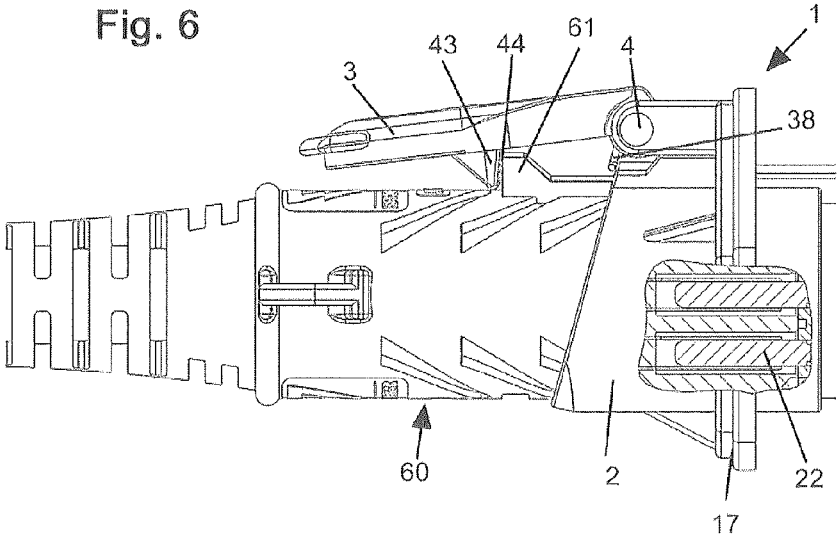

SOCKET FOR AN ELECTRICAL PLUG-AND-SOCKET CONNECTION

BACKGROUND OF THE INVENTION

The present technology relates to a socket for an electrical plug-and-socket connection generally used for the electrical interconnection of a tow vehicle or truck and a trailer. Typically, trailers are equipped with cylindrical formed plugs having a central contact terminal surrounded by a number of perimeter contact terminals. A well-known standard for such a plug and the corresponding socket is the SAE J560 describing a seven pole plug and socket connection. The contact terminals of the plug are wired to the electrical circuit of the trailer and in particular connected to the breaks, turn signals, running signals, and break signals of the trailer. For connecting the trailer to the electrical circuit of the tow vehicle, a socket for connection with the before described plug is mounted at the rear end of the tow vehicle which is suited for matching the contact terminals.

A similar socket according to another standard is known from U.S. Pat. No. 7,828,708 B2 describing a socket with a housing, a plug-in opening for mounting a plug, and a contact support insert positioned inside the housing. The contact support insert includes contacts extending into the plug-in opening which, however, are designed as flat contacts with an elastically bent contact surface. In order to provide a sealed socket the housing and the contact support insert are comprised of the same material as a single component produced in two consecutive injection molding steps. The rear end of the contacts might be contacted by a suited plug connected to wires leading to the electrical circuit of the tow vehicle. However, the rear end of the socket for connection with the wires to the electrical circuit of the tow vehicle is not sealed and the plug for connecting to the rear end of the contacts cannot be safely secured to a housing of the socket.

In the WO 2012/019625 A1 a similar socket is disclosed having a hold-closed mechanism that increases the holding force of the cover in the closed position in order to enhance the sealing properties of the hinge-mounted cover of the socket housing. However, the sealing of the contact area of the contacts inserted into the contact insert is not addressed. Further, the rear connection of these contacts is not sealed and specifically secured so that moisture can ingress the contact area of the rear contacts for connection with the electrical circuit of the tow vehicle. Further, the plug for connecting a socket with the electrical circuit of the tow vehicle is not additionally secured to the socket. This might lead to a drop-off of this plug from the socket due to e.g. vibration of the vehicles in use.

The EP 2 535 985 A1 discloses a socket for another plug-and-socket connection according to another (European) standard for the electrical connection of a trailer to a tow vehicle. In this embodiment, the contact insert and the socket housing are injection molded as an integral part with the contacts included into the contact insert. For connecting the contacts in the contact insert to the wires of the harness of the tow vehicle, receptacle contacts connected with wires leading to the electrical circuit of the tow vehicle are inserted into respective openings of the contact insert for contacting the rear side of the contacts provided in the contact insert. The wires are sealed by wire seals surrounding the wire and sealing the wire against the inner surface of the respective opening of the contact insert. However, each of the receptacle contacts have to be inserted individually into the contact insert which is cumbersome and error-prone. Another known alternative stipulates to provide a harness assembly directly and fixed connected with the socket to be mounted in the vehicle. However, the handling of such an integral assembly is difficult. Further, if the socket is mechanically damaged, the change of the socket is laborious and costly because the complete harness including the socket has to be dismounted and newly assembled.

SUMMARY OF THE INVENTION

It is accordingly an object of the present invention to provide a sealed socket that can be easily produced and assembled with the tow vehicle.

It is another object of the present invention to safely secure the harness of the electrical circuit of the tow vehicle to the socket and to enable a dismounting of the harness at the socket for easily exchange the socket after e.g. a mechanical damage of the socket without the necessity to dismount the complete harness leading from the electrical circuit of the tow vehicle to the socket.

In this regard, the present invention provides an electrical plug-and-socket connection comprising a socket housing having a plug-in opening for mating with a plug, a cover for closing the plug-in opening if no plug is inserted into the socket, and a plurality of contacts fixed in the plug-in opening for connecting the plug; a contact insert with receptacle contacts to be contacted with said contacts by inserting said contact insert on connection ends of said contacts, said receptacle contacts being connectable with a wire each; a backshell to assemble said contact insert, said backshell being hold circumferentially in said socket housing and having a flexible latch for fixing in a recess of the socket housing as a snap fit; and a locking slider attached captive at said backshell and having two preferably flexible arms inserted into respective slits in said socket housing and said backshell, said slits in said socket housing and said backshell matching each other when said contact insert in said backshell is inserted on said connection ends of said contacts such that said arms of said locking slider inserted into said matching slits of said socket housing and of said backshell secure said backshell with said contact insert inserted onto the contacts.

BRIEF DESCRIPTION OF THE DRAWINGS

FIG. 5 is a partial cross-sectional three-dimensional view of the socket according to FIG. 1;

FIG. 6 is a cross-sectional view of a plug inserted to the socket according to FIG. 1.

DETAILED DESCRIPTION

Figure 1:
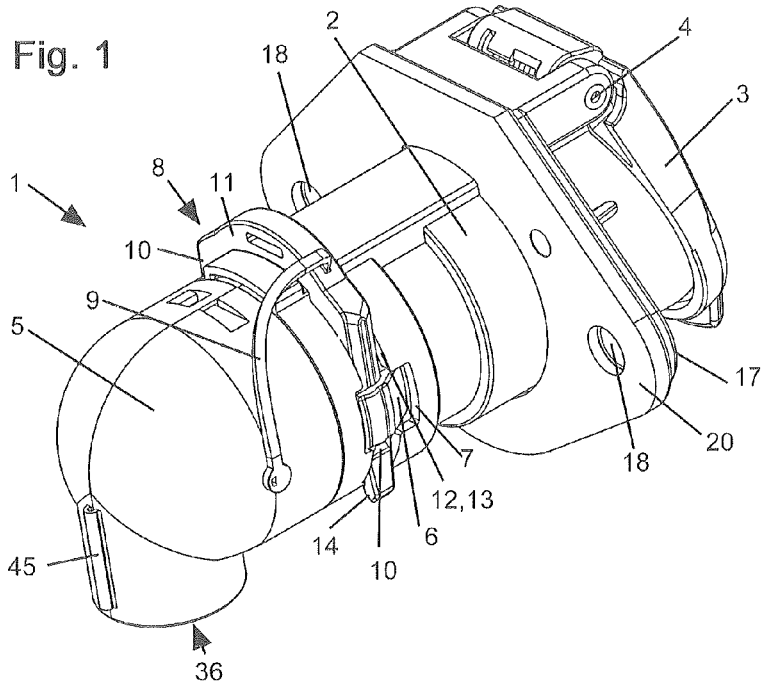
FIG. 1 is a three-dimensional rear view of the assembled socket of a preferred embodiment of the invention.

FIG. 1 shows a three-dimensional view of the socket 1 for an electrical plug-andsocket-connection between a trailer and a tow vehicle or truck. The socket 1 has a socket housing 2 having a plug-in opening (not visible in FIG. 1) for mating with a plug (not shown in FIG. 1). The plug-in opening is closed by a cover 3 if no plug is inserted into the socket 1. The cover 3 is hinged around an axis 4 to the socket housing 2 such that the plug-in opening can be opened by rotating the cover 3 around axis 4 away from the front face of socket housing 2 with the plug-in opening.

At the rear of the socket 1 opposite to the cover 3, a backshell 5 is provided which is hold circumferentially in the socket housing 2 and has a flexible latch 6 for fixing the backshell 5 in a recess 7 of the socket housing 2. Accordingly, the flexible latch 6 and the recess 7 build a snap fit for securing the backshell 5 safely at rear end of the socket housing 2.

In order to secure the assembly of the backshell 5 with the socket housing 2, a locking slider 8 is attached captive to the backshell by way of a flexible attachment arm 9 secured to the backshell 5. The locking slider 8 has substantially an U-form with two arms 10 and an intermediate portion 11 connecting the two arms 10 of the locking slider 8. After assembling the backshell 5 and the socket housing 2, the two arms 10 of the locking slider 8 are inserted into respective slits 12, 13 of the socket housing 2 and the backshell 5. The arms 10 of the locking slider 8 are guided in the slits 12, 13 of the socket housing 2 and the backshell 5 and covered by the flexible latches 6 positioned in the recess 7 of the socket housing 2. Accordingly, the arms 10 are secured against a possible rotation of the locking slider 8 around the circumferential outer wall of the socket housing 2. Further, after insertion of the locking slider into the slits 12, 13, the flexible latches 6 are secured against being pressed inwardly and losing the engagement with the border walls of the recess 7 for enabling detachment of the backshell 5 from the socket housing 2. Thus, the assembly of the socket housing 2 and the backshell 5 is secured with the locking slider 8 inserted into the slits 12, 13.

Figure 2:
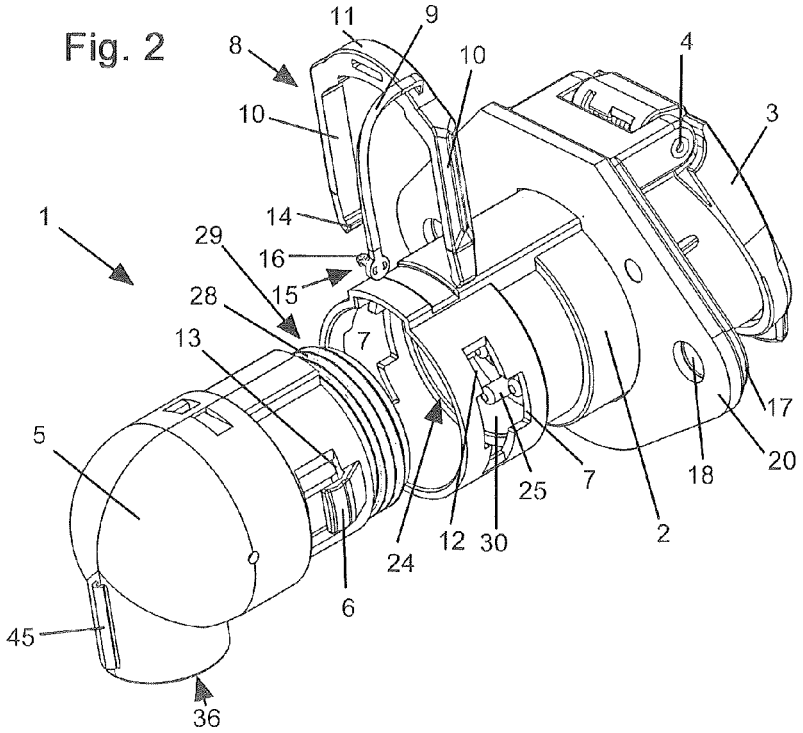
FIG. 2 is a three-dimensional view similar to FIG. 1 with separated socket housing and backshell.

For disassembling the socket 1 it is, thus, necessary to pull the locking slider 8 out of the slits 12, 13 and then to push both flexible latches 6 inwardly while pulling the backshell 5 in the direction opposite to the cover 3 of the socket 1. This is evident also from FIG. 2 showing the socket according to FIG. 1 in such a disassembled state. In the socket housing 2 preferably two recesses 7 and two slits 12 traversing the recesses 7 are provided positioned opposing to each other in the circumferential wall of the socket housing.

At respective positions of the backshell 5, the flexible latches 6 are positioned to to snap into the recesses 7 when assembling the backshell 5 at the rear end of the socket housing 2. The slit 13 is partially covered by the flexible latches 6.

As an exploded view, the locking slider 8 is shown in FIG. 2 completely detached from the backshell 5. The locking slider 8 has two arms 10 connected at one end of the arms 10 by an intermediate portion 11 to substantially build an U-form. At the open ends of the two arms 10 protrusions 14 are provided for securing the locking slider 8 inserted into the slits 12, 13 at the circumferential wall of the socket housing 2 by snapping around the end of the slit 12 of the socket housing 2 upon inserting the locking slider 8 into the slits 12, 13. To this aim, the arms 10 of the locking slider 8 have a certain degree of flexibility. The locking slider 8 might be formed of a suited plastic material and can e.g. be injection molded.

At the intermediate portion 11, the flexible attachment arm 9 might be fixed with one end. At the other end of the flexible arm 9, a pin 15 having an attachment snap fit 16 is protruding from the attachment arm 9 for securing the attachment snap fit 16 in a respective opening of the backshell 5.

For fixing the socket 1 at the tow vehicle, the socket 1 may have a flange 17 with preferably two mounting holes 18 opposite two each other with respect to the circumferential wall of the socket housing 2. When fixing the socket 1 to the tow vehicle, a hole in a size and form corresponding to a rear end of the socket housing 2 of the socket 1 may be provided in an attachment plane of the tow vehicle. Then, the rear end of the socket housing 2, i.e. the end to which the backshell 5 is attached, is inserted into the mounting hole until the flange 17 and positioned on the mounting plane. The socket 1 can be attached, e.g. by screws, through the mounting holes 18 at the mounting plane. In order to secure the attachment of the socket 1 at the mounting plane of the tow vehicle, the mounting holes 18 might be surrounded by metal sleeves 19. Further, between the mounting plane of the tow vehicle and the flange 17, a flange seal 20 may be positioned to avoid that moisture enters through the mount opening into the tow vehicle.

Thus, the socket housing 2 of the socket 1 can easily be mounted and dismounted from the tow vehicle if the backshell 5 is not assembled with the socket housing. In case of damage of the socket 1, e.g. a mechanical damage of the socket housing 2, the backshell 5 connected with the harness of the tow vehicle can be detached from the socket housing 1 as described above. Then the damaged socket housing 2 can be dismounted from the two vehicle and be replaced with a new socket housing 2 to which in turn the backshell 5 is reassembled. Thus, a replacement of the socket housing is easy and inexpensive.

With respect to the cross-sectional view of FIG. 3, the design of the inner shape of the socket 1 is explained in detail in the following.

Figure 3:
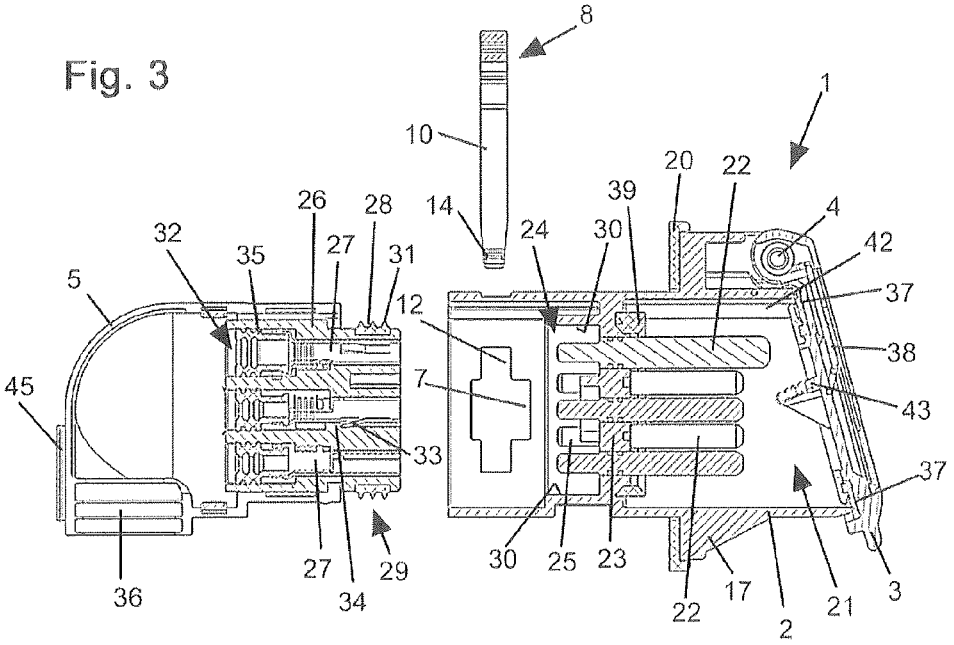
FIG. 3 is a cross-sectional view of the assembly according to FIG. 2.

Protected by the cover 3 of the socket 1, there is provided within the socket housing 2 the plug-in opening 21 for mating with a plug (not shown in FIG. 3). In the plug-in opening 21 a plurality of contacts 22 are fixed for connecting the plug when the plug is inserted into the socket 1. According to a preferred embodiment meeting the requirements of the before mentioned SAE-standard, the contacts may preferably be turned contacts 22 that are fixed in a bottom 23 of the plug-in opening 21 and preferably integrally formed with the socket housing 2.

The turned contacts 22 may be overmolded with the socket housing 2 for avoiding moisture to enter along the turned contacts 22 from the plug-in opening 21 into the contacting area 24 into which connection ends 25 of the turned contact 22 are extending.

For electrically connecting the connection ends 25 of the turned contacts 22 with the electrical circuit of the tow vehicle, a contact insert 26 with receptacle contacts 27 is provided, the receptacle contacts 27 being connected via wires not shown in the drawings to the electrical circuit of the tow vehicle. The receptacle contacts 27 are connected with the turned contacts 22, and more precisely with the connection ends 25 of the turned contacts 22 by inserting the contact insert 26 on the connection ends 25 of the turned contacts 22. This is shown in the assembled socket 1 according to FIG. 4.

The contact insert 26 is assembled in the backshell 5. The backshell 5 may be composed of two halves hinged around a flexible joint 45 being integrally formed with the two halves of the backshell 5. When the two halves of the backshell 5 are open, the contact insert 26 can easily be assembled within one of the two halves of the bachshell 5. By rotating the halves of the backshell 5 around the flexible joint 45 and clipping the two halves of the backshell 5 together, the contact insert 26 is fixed and secured within the backshell 5.

As the rear end of the socked housing 2 is open to the contacting area 24 with the connection ends 25 of the turned contacts 22, by introducing the backshell 5 with the contact insert 26 into the rear end of the socket housing 2 the receptacle contacts 27 are inserted on the connection ends 25 of the turned contacts 22.

For avoiding the entry of moisture into the contacting area 24 after assembling the backshell 5 with the socket housing 2, there may be provided a lamella seal 28 attached on a circumferential outer surface 29 of the contact insert 26 protruding from the backshell 5. As evident from FIG. 4, when the contact insert 26 is inserted onto the connection ends 25 of the turned contacts 22, the lamella seal 28 is abutting against a circumferential inner surface 30 disposed inside the socket housing 2 around the connection ends 25 of the turned contacts 22 thereby defining the contacting area 24. Thereby, sealing of the contacting area 24 between the contact insert 26 and the turned contacts 22 against moisture is securely achieved.

The lamella seal 28 has preferably two or more, in particular three lamellas 31.

For introducing the—not shown—wires into the receptacle contacts 27, the contact insert 26 may provide wire openings 32 at its rear end opposite to the circumferential outer surface 29 for inserting the receptacle contacts 27 and the wires attached to the receptacle contacts 27. The wires may be crimped to the receptacle contacts 27 and inserted into the contact insert 26. For securing the receptacle contacts 27 in the wire opening 32, there might be, as generally known to the one skilled in the art, latches 33 protruding from the receptacle contacts 27 for abutment against a protrusion 34 provided at the structured inner surface of the wire opening 32.

For sealing the rear end of the wire opening 32 a wire seal 35 may be inserted into the wire opening 32 around each wire connected to the receptacle contact 27 so that no moisture can enter into the contact insert 26 from a rear end through the wire opening 32.

For leading the—not shown—wires from the receptacle contact 27 out of the backshell 5 towards the electrical circuit of the towing vehicle, a structured opening 36 may be provided in the backshell 5 for fixing a corrugated tube surrounding the wires to the electrical circuit of the tow vehicle as a protection layer.

In order to further avoid moisture entering into the plug-in opening 21 when the cover 3 is closed and no plug is inserted into the socket 1, the cover 3 is preferably equipped with a cover seal 37 abutting against the front face of the wall surrounding the plug-in opening 21 of the socket housing 2. For achieving an equally distributed abutting force ensuring a good sealing between the cover seal 37 and the socket housing 2, the cover 3 may be equipped with a spring 38 with center-point rest carrying a closing force to the cover 3 in abutment against the front face of the wall surrounding the plug-in opening 21 of the socket housing 2.

Further, on the bottom 23 of the plug-in opening 21 there may be provided a basically round plug seal 39. The plug seal 39 has at least one lamella 40 for abutment against the front face of a plug inserted into a plug-in opening 21 of the socket housing 2 for sealing the contact area between the turned contacts 22 protruding into the plug-in opening 21 and the plug. According to a preferred embodiment, this plug seal 39 might have at least two lamellas 40, 41, wherein one round lamella 40 is provided for completely surrounding the turned contacts 22 and a bend lamella 41 is diverging from the round lamella at a certain part of the plug seal 39 building in this part a seal 39 with two lamellas 40, 41. The plug seal 39 can be best seen in FIG. 5 in which the plug-in opening 21 of the socket housing is shown in a partial cross-sectional view.

The part of the plug seal 39 having two lamellas 40, 41 may be disposed in front of a guiding recess 42 of the inner circumferential wall of the plug-in opening 21 in the socket housing 2. In this configuration, the plug seal 39 is ready to provide a secure seal against moisture for different plug forms according to the above identified SAE-standard.

The plug seal 39, however, is optional and can be glued in or just inserted into a respective nut in the bottom 23 of the plug-in opening 21.

Figure 4:
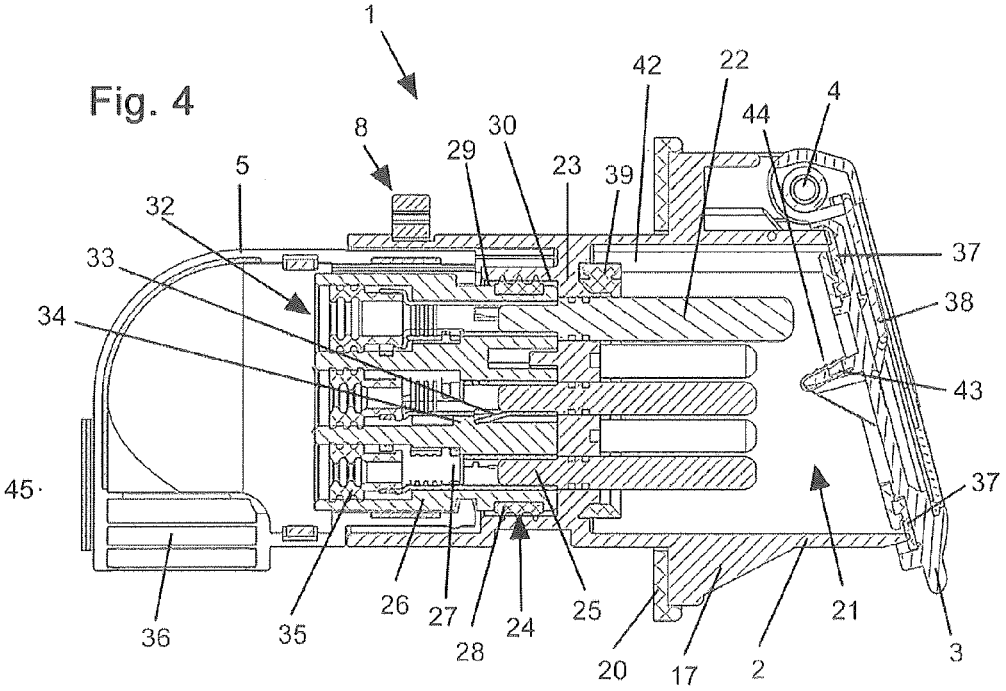
FIG. 4 is a cross-sectional view of the assembly according to FIG. 1.

As best seen in FIG. 4, approximately in the mid of cover 3, there is provided a spring clasp 43 with a grain structure 44 protruding from the inner surface of the cover 3 and positioned such that a plug inserted into the socket 1 is secured within the plug-opening 21 of the socket 1. To this aim, the grain structure 44 of the spring clasp 43 engages a plug protrusion 61 of a plug 60 connected to the electrical circuit of a trailer. This is shown in FIG. 6.

For pulling out the plug 60 of the socket 1, it is necessary to open the cover 3 against the recess force of the spring 38 even further until the spring clasp 43 is not abutting against the plug protrusion 61 of the plug 60. Then the plug 60 can be pulled off the socket 1.

Figure 7:
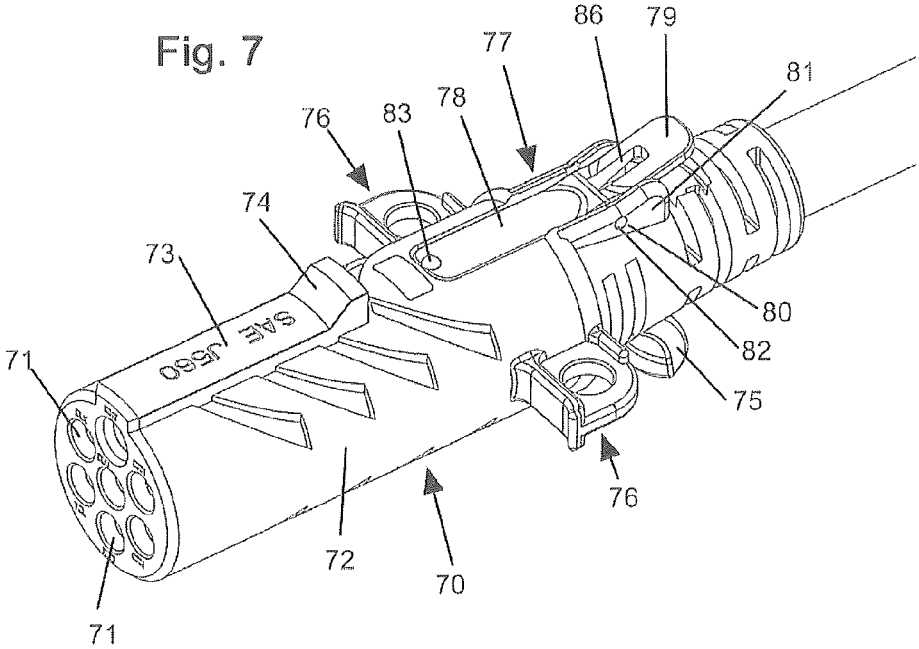
FIG. 7 is a three-dimensional view of a plug for insertion into the socket according to FIG. 1.

FIG. 7 discloses a plug 70 according to another aspect of the invention regarding the electrical plug-and-socket connection. Inside the plug 70, there are provided plug contacts not shown being accessible through the plug openings 71 arranged such that they are inserted onto the turned contacts 22 of a socket 1 when the plug 70 is inserted into the plug-in opening 21 of the socket 1. The plug contacts are contacted with wires also not shown in the FIGS. 7 to 9 describing this aspect of the invention.

The plug body 72 is preferably integrally formed around the plug contacts and the wires, e.g. by injection molding. The plug 70 has a guiding protrusion 73 extending from the front face of the plug with the plug openings 71 to the plug protrusion 74 for interacting with the spring clasp 43 of the cover 3 of the socket 1 as previously described with regard to FIG. 6. The guiding protrusion 73 is guided within the guiding recess 42 provided within the plug-in opening 21 of the socket 1. This matching of the guiding protrusion 73 with the guiding recess 42 ensures a correct orientation of the plug 60, 70, 90 when inserted into the socket 1. A handle 75 is integrally formed with the plug body 72 to ease pulling the plug 70 off the socket 1. Additionally, there might be two side handles 76 integrally formed with the plug body 72.

The plug described so far conforms to the before identified SAE-standard and generally known to the one skilled in the art.

However, with the existing plugs it is somewhat cumbersome to pull the plug off the socket as with one hand the cover 3 has been further opened to dissolve the engagement between the spring clasp 43 of the socket 1 and the plug protrusion 61, 74 of the plug 60, 70, 90, while the plug is pulled off the socket with the other hand. It is, therefore, an object of the present disclosure to enable a one-hand handling of pulling a plug off a socket.

To this aim, a dissolving arm 77 is hinged to the plug body 72 in further extension of the guiding protrusion 73 and the plug protrusion 74 towards the rear end of the plug 70, i.e. away from the front face of the plug 70 having the plug openings 71.

The dissolving arm 77 has a lift part 78 showing towards the guiding protrusion 73 and the plug protrusion 74 and a handling part 79 showing towards the opposite end of the plug 70 in one line with the lift part. The handling part 79 is bent upwardly from the surface of the plug body 72. At the position, where the lift part 78 and the handling part 79 are meeting, an axis 80 of the dissolving arm 77 is provided which is rotatably mounted in a bearing 81 integrally formed with the plug body 72 and having axis holes 82 in which the axis 80 of the dissolving arm 77 can be rotated together with the dissolving arm 77.

The useful function of the dissolving arm 77 is described in the following with respect to FIG. 9.

When the handling part 79 of the dissolving arm 77 is pressed down in direction of the plug body 72, the lift part 78 of the dissolving arm 77 moves up away from the plug body 72 due to a rotation of the axis 80 in the axis hole 82 disposed in the bearing 81 of the dissolving arm 77. This position of the dissolving arm 77 is shown in FIG. 9.

When the lift part 78 of the dissolving arm 77 is lifted up, it also pulls up the cover 3 such that the spring clasp 43 does not engage the plug protrusion 74 of the plug 70, thus allowing one pull the plug 70 off the socket 1. This can be achieved in a one-hand handling as the handling part 79 of the dissolving arm 77 might be pressed down by the thumb while the index finger strikes the handle 75 to pull off the plug 70.

In order to prevent damage to the inner wall of the cover 3 and in particular the cover seal 37, there may be provided a rounded knob 83 at the free end of the lift part 78 of the dissolving arm 77 such that the rounded knob 83 engages with the inner surface of the cover 3 when the lift part 78 of the dissolving arm 77 is lifted by pressing the handling part 79 down towards the plug body 72. Due to the rounded structure of the knob 83 there does not occur any damage at the inner wall of the cover 3 and the cover seal 37.

As mentioned, the bearing 81 with the axis hole 82 can be integrally formed with the plug body 72, e.g. by injection molding.

Further, the dissolving arm 77 can be integrally formed as one single part, e.g. by injection molding, with the lift part 78, the handling part 79 and the axis 80. Thus, the dissolving arm 77 can be assembled with the plug 70 by simply clicking the pin-like axis 80 in form of protruding pins into the axis holes 82 of the bearing 81. Accordingly, the plug 70 having the dissolving arm 77 is cheap in production and can easily be assembled.

In order to assure that the lift part 78 of the dissolving arm 77 is aligned with the plug body 72 when the handling part 79 is not pressed down, there is a recess 84 provided in the plug body 72 to receive the lift part 78 of the dissolving arm 77. For avoiding that the lift part 78 is lifted from the plug body 72 unintentionally there can be provided a flexible latch 85 being arranged in V-form with the handling part 79, the flexible 85 latch being preferably also integrally formed with the dissolving arm 77. This flexible latch 85 has the function of a spring element creating a pre-tensioning of the lift part 78 of the dissolving arm 77 towards the plug body 72. When pressing the handling part 79 down, the flexible latch 85 is bent towards the handling part 79 of the dissolving arm 77, thus allowing to lift the lift part 78.

Figure 10:
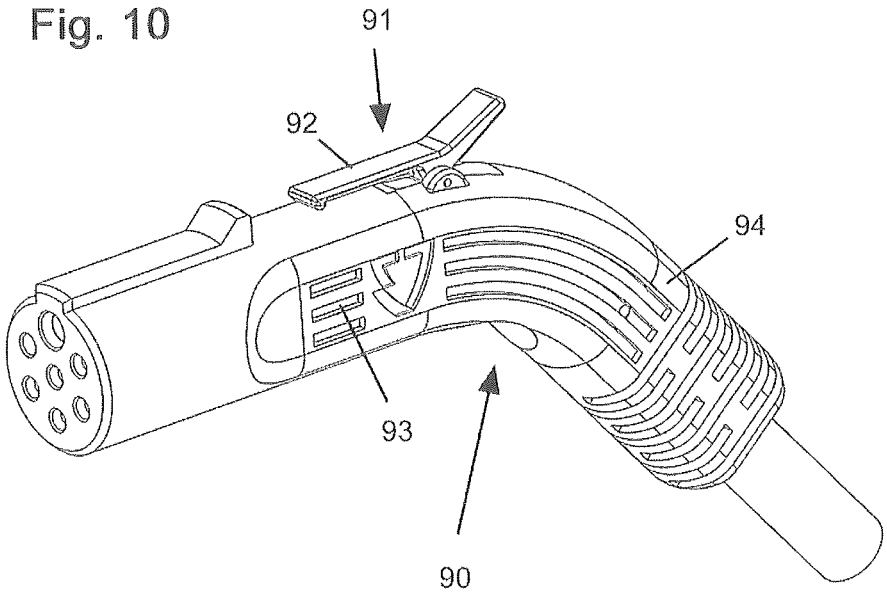
FIG. 10 is a three-dimensional view of a gun-formed plug for insertion into the socket according to FIG. 1.

FIG. 10 shows another plug 90 which is basically identical to the plug 70 as described before with regard to the functioning of the dissolving arm 91 with the difference that the lift part 92 of dissolving arm 91 is not received in a recess of the plug body 93 of this plug 90. For the description of the other features, reference is made to the before description.

Figure 8:
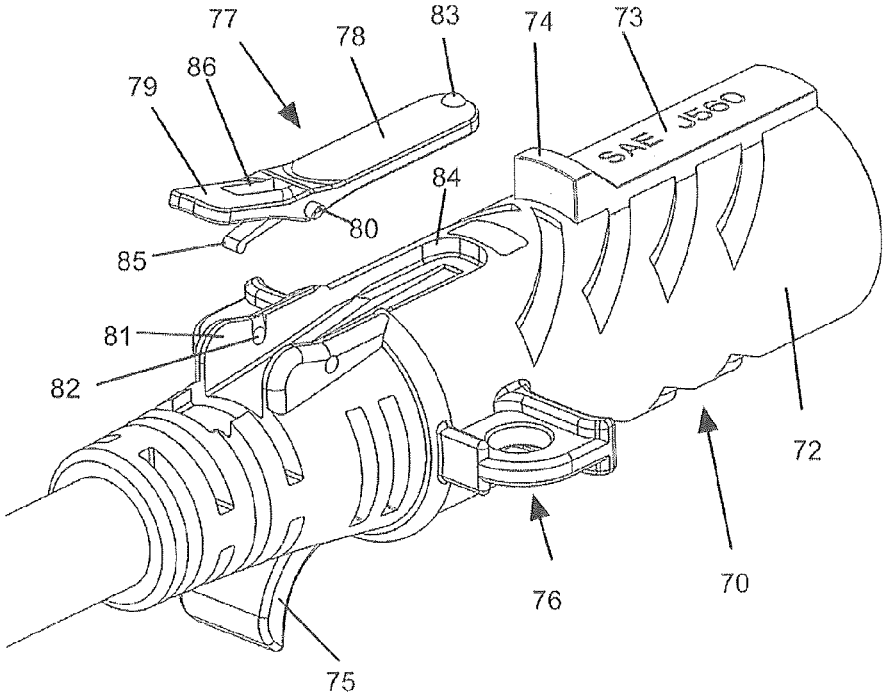
FIG. 8 is an exploded view of the plug according to FIG. 7.
Figure 9:
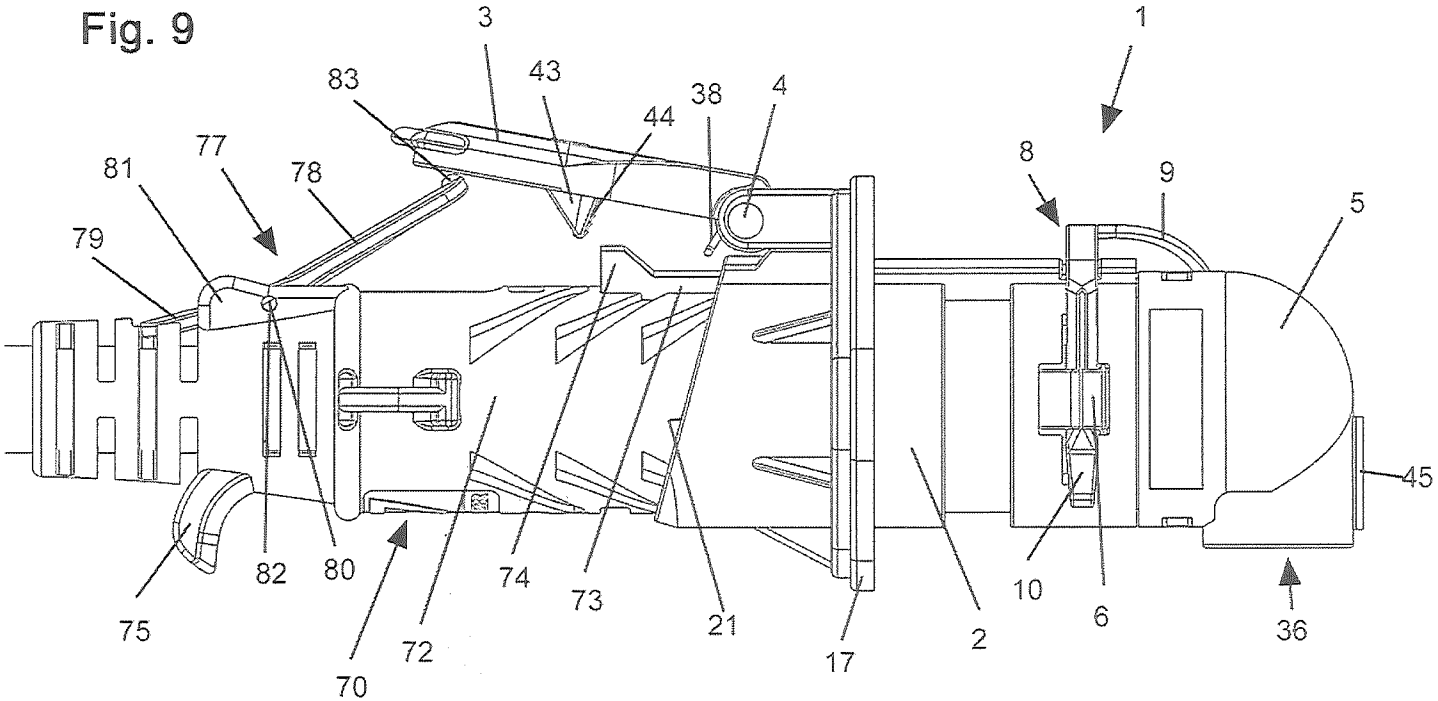
FIG. 9 is a side view of the plug according to FIG. 7 inserted into the socket according to FIG. 1.

However, instead of a handle 75 protruding from the plug body 72 as shown for the plug 70 in the FIGS. 7 to 9, the plug body 93 of the plug 90 is bent downwards, i.e. away from the dissolving arm 91, thus forming a handle 94 of the plug 90. This handle 94 can easily be enfolded with the complete hand while the thump is actuating the dissolving arm 91 as previously described. This plug 90 has a gun-like form.

LIST OF REFERENCE NUMBERS

1 socket
2 socket housing
3 cover
4 axis
5 backshell
6 flexible latch
7 recess
8 locking slider
9 flexible attachment arm
10 arm of locking slider
11 intermediate portion
12 slit of the socket housing
13 slit of the backshell
14 protrusion
15 pin
16 attachment snap fit
17 flange
18 mounting holes
19 metal sleeve
20 flange seal
21 plug-in opening
22 contact
23 bottom
24 contacting area
25 connection end
26 contact insert
27 receptacle contacts
28 lamella seal
29 cirumferential outer surface
30 cirumferential inner surface
31 lamella
32 wire opening
33 latch
34 protrusion
35 wire seal
36 structured opening
37 cover seal
38 spring with center-point-rest
39 plug seal
40 round lamella
41 bend lamella
42 guiding recess
43 spring clasp
44 grain structure
45 flexible joint
60 plug
61 plug protrusion
70 plug
71 plug opening
72 plug body
73 guiding protrusion
74 plug protrusion
75 handle
76 side handle
77 dissolving arm
78 lift part
79 handling part
80 axis
81 bearing
82 axis hole
83 rounded knob
84 recess

85 latch, spring element
90 plug
91 dissolving arm
92 lift part
93 plug body
94 handle

What is claimed:

1. A socket for an electrical plug-and-socket connection, comprising:

(a) a socket housing having a plug-in opening for mating with a plug, a cover for closing the plug-in opening if no plug is inserted into the socket and a plurality of contacts fixed in the plug-in opening for connecting the plug;

(b) a contact insert with receptacle contacts to be connected with said contacts by inserting said contact insert on connection ends of said contacts, said receptacle contacts being connectable with a wire each;

(c) a backshell to assemble said contact insert, said backshell being held circumferentially in said socket housing and having a flexible latch for fixing in a recess of the socket housing as a snap fit; and (d) a locking slider captively attached at said backshell and comprising two arms insertable into respective slits in said socket housing and said backshell, said slits in said socket housing and said backshell matching each other when said contact insert in said backshell is inserted on said connection ends of said contacts such that said arms of the locking slider inserted into said matching slits of said socket housing and of said backshell secure said backshell with said contact insert inserted onto the contacts.

2. The socket according to claim 1 wherein said slit in said socket housing is traversing said recess for receiving and locking said flexible latch and said slit in said backshell is positioned under said flexible latch such that an arm of said locking slider inserted into said slits is blocking a movement of said flexible latch towards the contact insert such avoiding unlocking of said snap fit.

3. The socket according to claim 1 wherein the locking slider has substantially an U-form with open ends of the two arms having protrusions for securing the inserted locking slider at the circumferential wall of the socket housing at the end of said slit in the socket housing.

4. The socket according to claim 1 wherein said locking slider has a flexible attachment arm secured to a mid-portion of said locking slider and a pin with an attachment nut protruding from said attachment arm for securing said attachment nut in an opening of said backshell.

5. The socket according to claim 1 wherein said backshell provides an opening with a structured surface for holding a corrugated tube.

6. The socket according to claim 1 wherein said contact insert has a circumferential outer surface protruding from the backshell and a lamella seal attached on said protruding surface, said lamella seal abutting against an circumferential inner surface disposed in said socket housing when said contact insert is inserted on said connection ends of said contacts thereby sealing the contacting area between said contact insert and said turned contacts against moisture.

7. The socket according to claim 6 wherein the lamella seal comprises two or more lamellas.

8. The socket according to claim 6 wherein the lamella seal comprises three lamellas.

9. The socket according to claim 1 wherein a wire seal is inserted into said wire openings of said contact insert to seal each wire connected to said receptacle contacts against said wire opening for avoiding moisture to enter into said contact insert.

10. The socket according to claim 1 wherein said contacts are overmolded with said socket housing for avoiding moisture to enter along said contacts form said plug-in opening into the contacting area between said contact insert and said contacts.

11. The socket according to claim 1 wherein a plug seal is disposed on the bottom of said plug-in opening around said contacts, said plug seal having at least one lamella for abutment against the front face of a plug inserted into the plug-in opening of the socket housing for sealing the contact area between the contacts and the plug.

12. The socket according to claim 11 wherein the plug seal has at least partially two lamellas.

13. The socket according to claim 12 wherein a round lamella is provided for surrounding the contacts and a bend lamella is diverging from said round lamella at a certain part of said plug seal building in said part a seal with two lamellas.

14. The socket according to claim 13 wherein the part of said plug seal having two lamellas is disposed in front of a guiding recess in the inner circumferential wall of the plug-in opening in the socket housing.

15. The socket according to claim 1 wherein said cover is equipped with a cover seal abutting against the front face of the wall surrounding the plug-in opening when the cover is closed for preventing moisture from entering said plug-in opening when no plug is inserted into the socket.

16. The socket according to claim 1 wherein the cover is equipped with a spring with center-point-rest.

17. The socket according to claim 1 wherein a spring clasp with a grain structure is protruding from an inner surface of the cover and positioned such that a plug inserted into the socked is secured within the plug-in opening of the socket.

18. The socket according to claim 1 wherein the contacts comprise turned contacts.

* * * * *